United States Patent [19]

Tam

[11] Patent Number: 4,585,223

[45] Date of Patent: Apr. 29, 1986

[54] ENVELOPE FEEDER

[76] Inventor: Alexander Tam, 1282 Mattox Rd., Apt. 40, Hayward, Calif. 94541

[21] Appl. No.: 536,043

[22] Filed: Sep. 26, 1983

[51] Int. Cl.[4] ..... B65H 3/06; B65H 3/54

[52] U.S. Cl. ..... 271/121; 271/126; 271/160; 271/165; 271/167

[58] Field of Search ..... 271/126, 9, 10, 121, 271/145, 124, 21, 22, 23, 165, 167, 169, 170, 160, 149

[56] References Cited

U.S. PATENT DOCUMENTS

| | | | |
|---|---|---|---|
| 3,323,792 | 6/1967 | Hartzell | 271/2 |
| 3,524,640 | 8/1970 | Dvorak | 271/160 |
| 3,539,179 | 11/1970 | Bergman et al. | 271/39 |
| 3,806,114 | 4/1974 | Carter | 271/149 |
| 3,807,725 | 4/1974 | Bookless | 271/171 |
| 4,268,021 | 5/1981 | Rutishauser et al. | 271/4 |
| 4,340,314 | 7/1982 | Berger | 400/625 |
| 4,362,100 | 12/1982 | Wu et al. | 101/233 |
| 4,394,568 | 7/1983 | Nakatsu | 271/165 |

FOREIGN PATENT DOCUMENTS

| | | | |
|---|---|---|---|
| 1936535 | 10/1970 | Fed. Rep. of Germany . | |
| 145948 | 11/1980 | Japan | 271/124 |
| 82746 | 7/1981 | Japan | 271/126 |
| 348541 | 5/1931 | United Kingdom . | |
| 8200994 | 4/1982 | World Intel. Prop. Org. | 271/121 |

*Primary Examiner*—Bruce H. Stoner, Jr.
*Assistant Examiner*—Lawrence J. Goffney, Jr.
*Attorney, Agent, or Firm*—Richard A. Tomlin; Serge Abend

[57] ABSTRACT

An envelope feeder for mounting on a computer printer, electronic typewriter, word processor or other programmable printer. The envelope feeder uses a centrally located drive separator roller and separating tongue to effect envelope separation.

6 Claims, 6 Drawing Figures

ENVELOPE FEEDER

This invention relates to an envelope feeder for mounting on a printer, the printer having a rotatable platen and an associated printing station. The envelope feeder utilizes a drive roller and a low-friction surface separator tongue, which concentrates the stripping force for envelope separation to the center of the envelope. This novel structure has been found to provide a reliable envelope feeder requiring lower driving force for envelope separation and feeding.

The envelope feeder of this invention is useful for programmable printing machines such as automatic typewriters, computers or word processors.

The advantages of the present invention will be better understood upon reading the detailed description in combination with the accompanying drawing, which shows a single preferred embodiment of the present invention, wherein.

Figure 1:
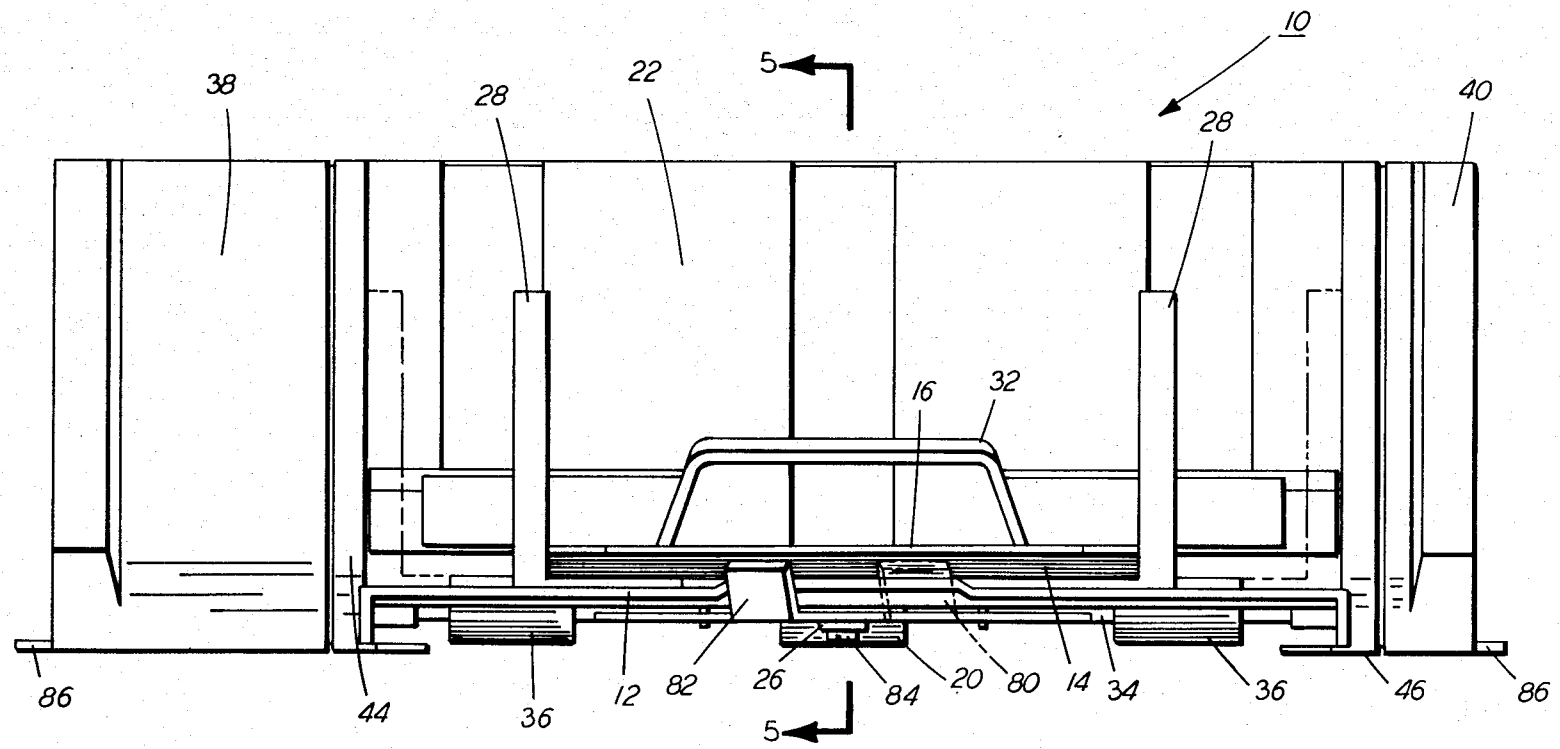
FIG. 1 is a back elevational view of the envelope feeder of this invention.

Referring now to the Figures, envelope feeder, generally designated 10, is made up of a support plate 12 having a low coefficient of friction surface for supporting envelopes 14 (best seen in FIG. 5), a pressure plate 16 urged by constant force spring means 18 (best seen in FIG. 2) to press the envelopes 14 against support plate 12, an envelope drive separator roller 20 having a high friction surface and a base plate 22 having a low-friction surface and a separator tongue 24 also having a low-friction surface. In operation, drive separator roller 20 is turned in the direction shown by the arrow in FIG. 5. The combination of the action of pressure plate 16 and the drive separator roller 20 high-friction surface forces the envelope 14 in contact with the drive separator roller 20 against base plate 22. This action causes the envelope to bend and slide along separator tongue 24. The friction force between the envelopes 14 is less than that between the envelope 14 and drive separator roller 20. Therefore, only the envelope in contact with the drive separator roller 20 is fed since there is not enough friction force between envelopes to cause them to bend and slide along separator tongue 24.

More specifically and referring to FIG. 1, there is shown a support plate 12 having raised low-friction surface 42 (see FIG. 5) thereon and having an envelope centering cam mechanism 26 having adjustable sidewalls 28 for manually centering the envelopes 14 on support plate 12, the operation of which will be discussed in detail in connection with FIG. 6.

Pressure plate 16 is provided with a handle 32 for manually withdrawing pressure plate 16 from envelopes 14 or support plate 12 when it is desired to add or remove envelopes 14. Envelope drive separator roller 20 is provided on drive shaft 34 along with two or more outboard drive rollers 36. The function of outboard drive rollers 36 is to prevent the fed envelope from skewing. Covers 38 and 40 are provided and are attached by conventional means (not shown) to envelope feeder 10.

Figure 2:
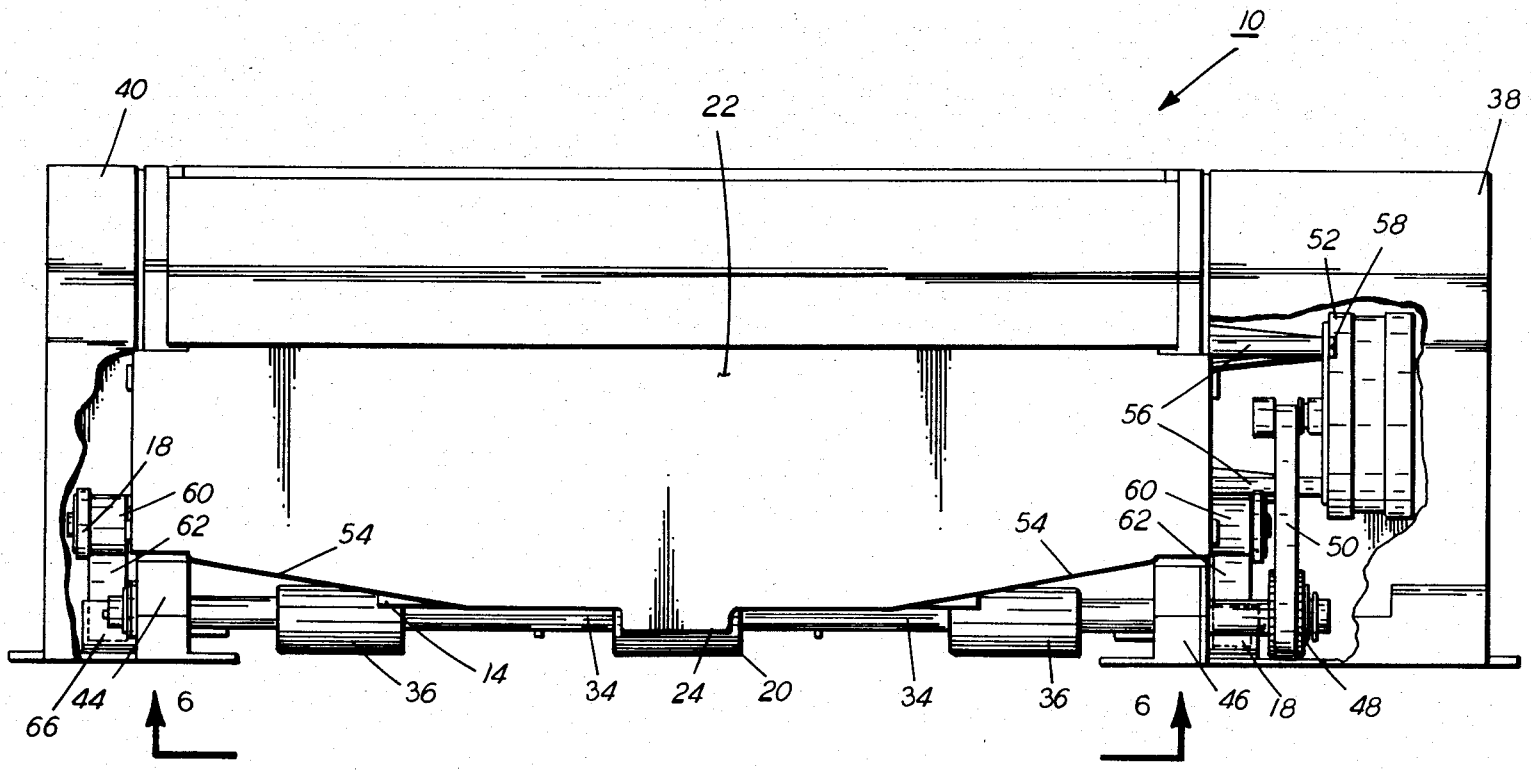
FIG. 2 is a front elevational view of the envelope feeder of this invention.

Referring now to FIG. 2, there can be seen that drive shaft 34 is mounted, with suitable bearing members, for rotation in sideplates 44 and 46, which are mounted on and which provide, with base frame member 45 (see FIGS. 3, 4 and 5), a rigid frame for envelope feeder 10 and its components. Drive shaft 34 has pulley 48 mounted for rotation therewith on one end. Pulley 48 is connected by belt 50 to drive motor 52. Motor 52 is mounted on sideplate 46 by means of posts 56 and screws 58. Drive control means (not shown) activate motor 52 when it is desired to feed an envelope 14. Motor 52, when activated, causes belt 50 to turn pulley 48, drive shaft 34, envelope drive separator roller 20 and drive rollers 36.

As can be seen in FIG. 2, base plate 22 has a separator tongue 24, which is a key component in the envelope feeder of this invention. Drive separator roller 20 and separator tongue 24 are the key components in the present system for envelope separation and feeding. It has been found that, by concentrating the separation function to a relatively small, central area of the envelope 14, a reliable feeder requiring minimal separation force is attained. In order to ensure that the separation forces are limited to the separation area, the lower edge 54 of base plate 22 is slanted away from separator tongue 24, the distance between the guide plate lower edge 54 and drive shaft 34 increasing with the distance from the center of the separator tongue 24 and drive separator roller 20.

Figure 4:
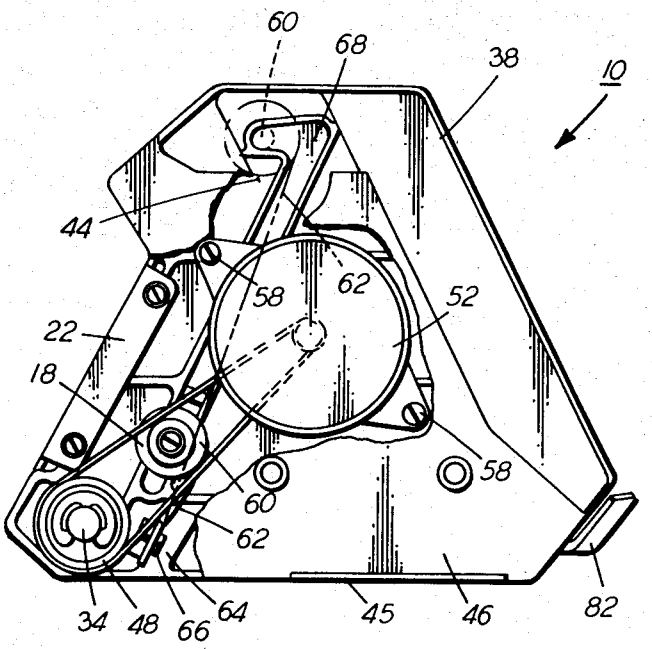
FIG. 4 is a left-side elevational view of the envelope feeder of this invention in partial section.
Figure 3:
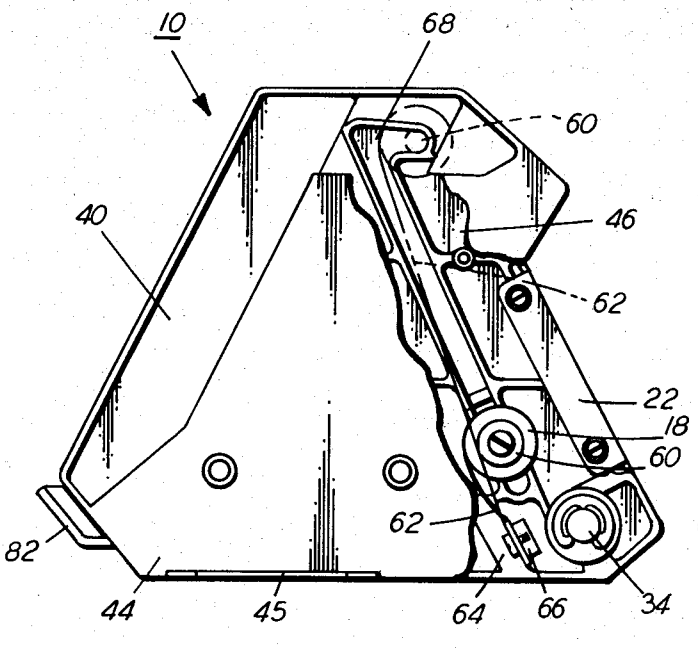
FIG. 3 is a right-side elevational view of the envelope feeder of this invention in partial section.
Figure 5:
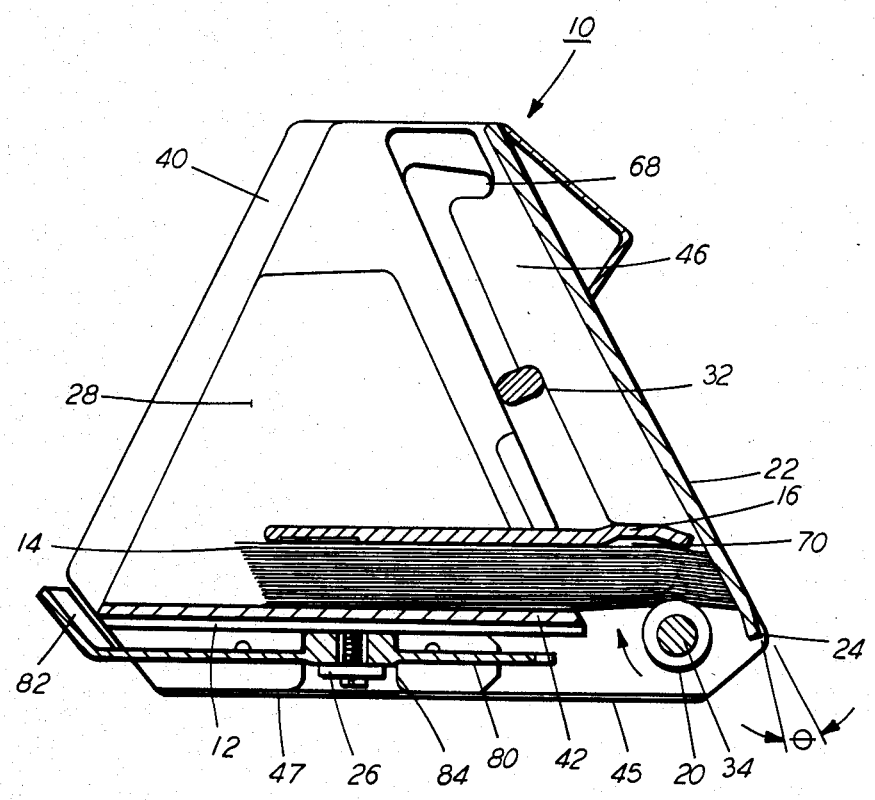
FIG. 5 is a section along lines 5—5 in FIG. 1.

The operation of the pressure plate 16 and constant force spring means 18 can best be understood by reference to FIGS. 3, 4 and 5. Pressure plate 16 has bearing means 60 rotatably mounted on each side edge of pressure plate 16. Wrapped around each bearing means 60 is a constant force spring 62. Constant force springs 62 are attached at the opposite end to flanges 64 on sideplates 44 and 46 by mounting means 66. Bearing means 70 are rotatably retained in L-shaped grooves 68 formed in sideplates 44 and 46. When pressure plate 16 has been raised to its highest position, it can be "parked" by placing the bearings 60 in the smaller section of the L-shaped groove 68 (the bearings 60 shown in broken line in FIGS. 3 and 4 in their parked position). This motion unwraps springs 62, also shown in broken line in the parked position. The constant force spring 62, once the bearing means 60 are released from the smaller section of the L-shaped groove 68, spring 62 is biased to wrap itself again around bearing means 60 thus biasing pressure plate 16 to which bearing means 60 are rotatably attached toward support plate 12. Spring 62 being a constant force spring provides relatively constant pressure on envelopes 14, a preferred feature. Pressure plate 16 is formed with an arch 70 (see FIG. 5) to allow for envelope bending in response to the action of pressure plate 16 forcing envelopes 14 against drive separator roller 20.

Figure 6:
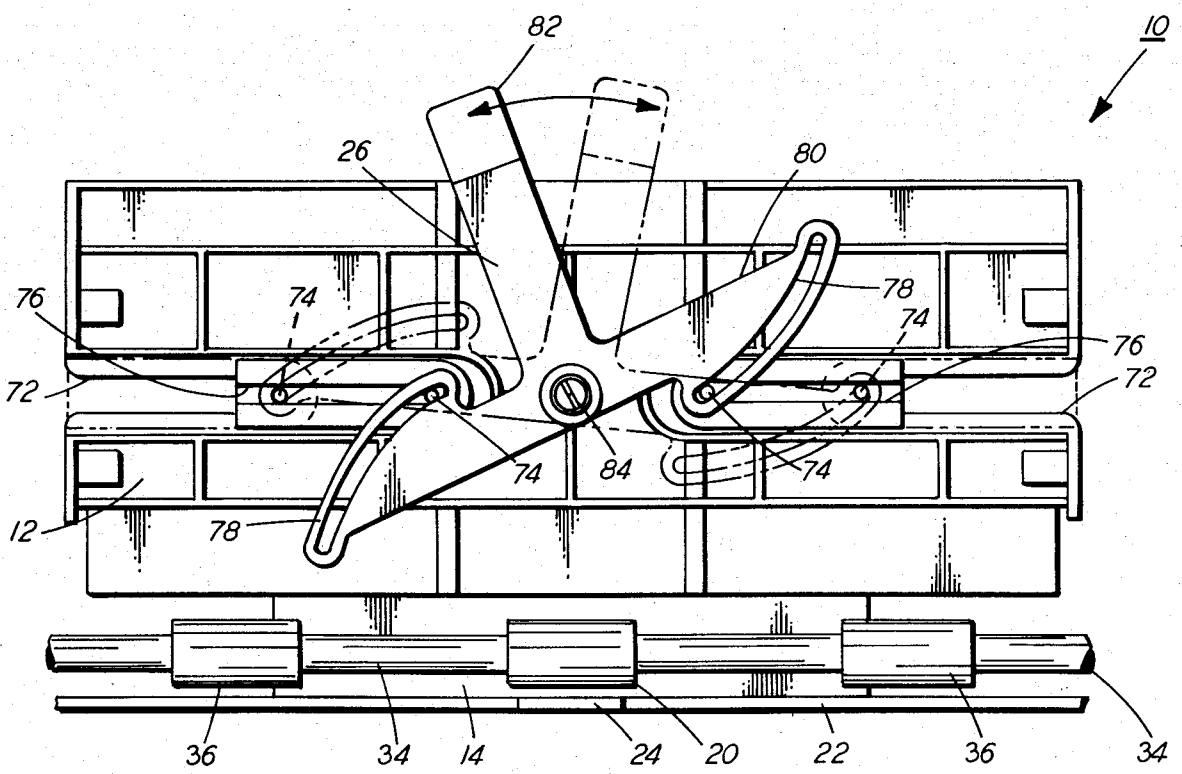
FIG. 6 is a bottom view of the envelope feeder of this invention taken along lines 6—6 in FIG. 2.

Another feature of the present envelope feeder 10 can best be understood by reference to FIGS. 1, 5 and 6. An envelope centering cam mechanism 26 is provided for manually centering envelopes 14 prior to feeding by bringing adjustable sidewalls 28 into contact with the sides of envelopes 14. To do this, sidewalls 28 and 30 are slidably mounted on support plate 12. Support plate 12 has slots 72 formed therein to allow passage of pins 74. Pins 74 are attached to adjustable sidewalls 28 such that as pins 74 are moved, sidewalls 28 move with them.

Formed as a part of support plate 12 are pin guide slots 76, which limit the motion of pins 74 to the left and right as seen in FIG. 6. Pins 74 ride against cam surfaces 78 formed in cam member 80. Cam member 80 is provided with a handle 82 for operation. Cam member 80 is rotatably mounted on frame base 47 by mounting means 84. In operation, handle 82 is first turned clockwise as shown in FIG. 6. This forces pin members 74 and the adjustable sidewalls 28, to which the pins are attached, to the extreme open position as shown in broken lines. After the envelopes 14 are inserted, handle 82 is moved counterclockwise as seen in FIG. 6 until adjustable sidewalls 28 come in contact with the sides of the envelopes 14 aligning them for feeding.

In a particularly preferred embodiment, separator tongue 24 measures about 25 mm wide and extends about 7 mm beyond the edge 54 of base plate 22. Generally, the separator tongue 24 should measure in width about 70 to 90 percent of the drive separator roller 20 width, with a preferred around 75 percent. The separator tongue 24 can extend from 4 to 10 mm. The gap between the drive separator roller 20 and separator tongue 24 can vary between about one-half and $1\frac{3}{4}$ inches.

The envelope feeder 10 of this invention may be mounted on a printer by any conventional means. For example, the covers 38, 40 may be provided with pins 86, which slide into grooves formed in the printer sidewalls (not shown).

Normally, although the drawing shows the envelopes lying horizontally, excellent results have been obtained with the base plate 22 at an angle of 50° to the horizontal and the support plate 12 at an angle of 65° to the horizontal. The envelope feeder is aligned so that drive shaft 34 is parallel to the printer platen (not shown). The drive separator roller 20 has a diameter of about 0.375 inches and is made of hard rubber. The separator tongue 24 is formed at a preferred angle $\theta$ of about 10° to the base plate 22, a range of $\pm 5°$ being acceptable, the tongue 24 being bent toward the drive separator roller 20 as shown in FIG. 5. The separator tongue 24 and base plate 22 are made of acetyl copolymer with 25 percent glass fiber.

While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An envelope feeder which comprises:

a low-friction support plate for supporting envelopes;

a pressure plate for pressing envelopes against said support plate;

a drive roller separator having a high-friction surface positioned to contact envelopes pressed against said support plate; and a separator tongue having a low-friction surface positioned such that envelopes driven by said drive roller separator are bent and are caused to slide along said separator tongue, said drive roller separator and said separator tongue being shaped to contact a center position only of fed envelopes, and wherein said pressure plate is formed with an arched end portion adjacent the drive roller separator to assist the bending of the envelopes.

2. The envelope feeder of claim 1 wherein said pressure plate is urged toward said support plate by constant force springs.

3. The envelope feeder of claim 1 wherein the leading edges of envelopes to be fed and held between the support plate and the pressure plate abut a base plate adjacent said separator tongue.

4. The envelope feeder of claim 3 wherein the separator tongue is formed as a projection from the end of a base plate, the base plate being tapered in the direction of envelope feed.

5. The envelope feeder of claim 3 wherein the separator tongue is inclined from the plane of the base plate towards the drive roller separator.

6. An envelope feeder which comprises:

a low-friction support plate for supporting envelopes;

a pressure plate for pressing envelopes against said support plate;

a drive roller separator having a high-friction surface positioned to contact envelopes pressed against said support plate; and a separator tongue having a low-friction surface positioned such that envelopes driven by said drive roller separator are bent and are caused to slide along said separator tongue, said drive roller separator and said separator tongue being shaped to contact a center portion only of fed envelopes, and wherein the leading edges of envelopes to be fed and held between the support plate and the pressure plate abut a base plate adjacent said separator tongue, and the separator tongue is inclined from the plane of the base plate towards the drive roller separator.

* * * * *